US010626625B1

(12) United States Patent
Hogan

(10) Patent No.: US 10,626,625 B1
(45) Date of Patent: Apr. 21, 2020

(54) CEMENTITIOUS MATERIAL SURFACE TEXTURING ASSEMBLY

(71) Applicant: Johnnie Hogan, Anderson, SC (US)

(72) Inventor: Johnnie Hogan, Anderson, SC (US)

(73) Assignee: Johnnie Ruth Hogan, Anderson, SC (US)

( * ) Notice: Subject to any disclaimer, the term of this patent is extended or adjusted under 35 U.S.C. 154(b) by 0 days.

(21) Appl. No.: 16/372,979

(22) Filed: Apr. 2, 2019

(51) Int. Cl.
*E04F 21/16* (2006.01)
*B01F 7/00* (2006.01)
*B01F 13/00* (2006.01)

(52) U.S. Cl.
CPC ..... *E04F 21/161* (2013.01); *B01F 7/00283* (2013.01); *B01F 13/002* (2013.01)

(58) Field of Classification Search
CPC ..... B01F 13/0018; B01F 13/002; B01F 13/0028; B01F 13/0033; B01F 7/00283; B25G 1/10; E04F 21/161
USPC ..... 366/129, 325.4, 325.5; 172/111
See application file for complete search history.

(56) References Cited

U.S. PATENT DOCUMENTS 264,781 A * 9/1882 Silveus ..... A01J 25/00 366/325.4
3,129,771 A * 4/1964 Lidstone ..... A01B 1/065 172/25
3,215,410 A * 11/1965 McMaster ..... A47J 43/0711 366/343
D207,413 S 4/1967 Gardner
4,132,502 A * 1/1979 Bunke ..... B01L 3/18 416/70 R
D361,632 S 8/1995 Ratia
D396,309 S 7/1998 Churchville
5,909,778 A * 6/1999 Acosta ..... A01B 1/065 172/111
5,918,963 A 7/1999 Churchville
6,220,639 B1 * 4/2001 Aquilina ..... B25G 3/14 294/57
6,722,444 B2 * 4/2004 McKill ..... A01B 1/065 172/111
6,736,217 B2 * 5/2004 Brown ..... A01B 1/065 172/111
7,070,409 B1 7/2006 Varrieur
7,258,479 B1 * 8/2007 Westby ..... B01F 7/0015 366/129

(Continued)

FOREIGN PATENT DOCUMENTS

WO WO2012018420 2/2012

*Primary Examiner* — Charles Cooley
(74) *Attorney, Agent, or Firm* — Kaufhold Dix Patent Law

(57) ABSTRACT

A surface texturing assembly includes a cementitious material that can be applied to an exposed surface for enhancing the ornamental appearance of the exposed surface. A swirling tool is provided and the swirling tool is manipulated to engage the cementitious material when the cementitious material is wet. The swirling tool has a pair of spaced members that each sinks into the cementitious material when the swirling tool is manipulated to engage the cementitious material. Moreover, the swirling tool is rotatable such that each of the spaced members travels in an arc to form a respective one of a pair of swirling arcs in the cementitious material. In this way the swirling tool is movable along an entirety of the exposed surface for shaping the cementitious material into a plurality of swirling, intersecting arcs.

8 Claims, 7 Drawing Sheets

(56) References Cited

U.S. PATENT DOCUMENTS

| | | | | |
|---|---|---|---|---|
| 8,381,358 | B1 * | 2/2013 | Frey | A45F 5/10 16/406 |
| 8,381,474 | B2 | 2/2013 | Lewis | |
| 8,413,304 | B1 * | 4/2013 | Tipton | B25G 1/10 16/422 |
| 8,550,014 | B1 | 10/2013 | Mariani | |
| 2008/0186800 | A1 * | 8/2008 | Jaffer | A47G 21/004 366/129 |
| 2009/0110502 | A1 * | 4/2009 | Brooks | B01F 7/00258 408/227 |
| 2014/0022774 | A1 | 1/2014 | Eastman | |
| 2014/0027320 | A1 | 1/2014 | Norris | |

* cited by examiner

CEMENTITIOUS MATERIAL SURFACE TEXTURING ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to texturing devices and more particularly pertains to a new texturing device for applying a cementitious material to a surface and subsequently texturing the cementitious material into a plurality of intersecting, swirling arcs.

BRIEF SUMMARY OF THE INVENTION

An embodiment of the disclosure meets the needs presented above by generally comprising a cementitious material that can be applied to an exposed surface for enhancing the ornamental appearance of the exposed surface. A swirling tool is provided and the swirling tool is manipulated to engage the cementitious material when the cementitious material is wet. The swirling tool has a pair of spaced members that each sinks into the cementitious material when the swirling tool is manipulated to engage the cementitious material. Moreover, the swirling tool is rotatable such that each of the spaced members travels in an arc to form a respective one of a pair of swirling arcs in the cementitious material. In this way the swirling tool is movable along an entirety of the exposed surface for shaping the cementitious material into a plurality of swirling, intersecting arcs.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
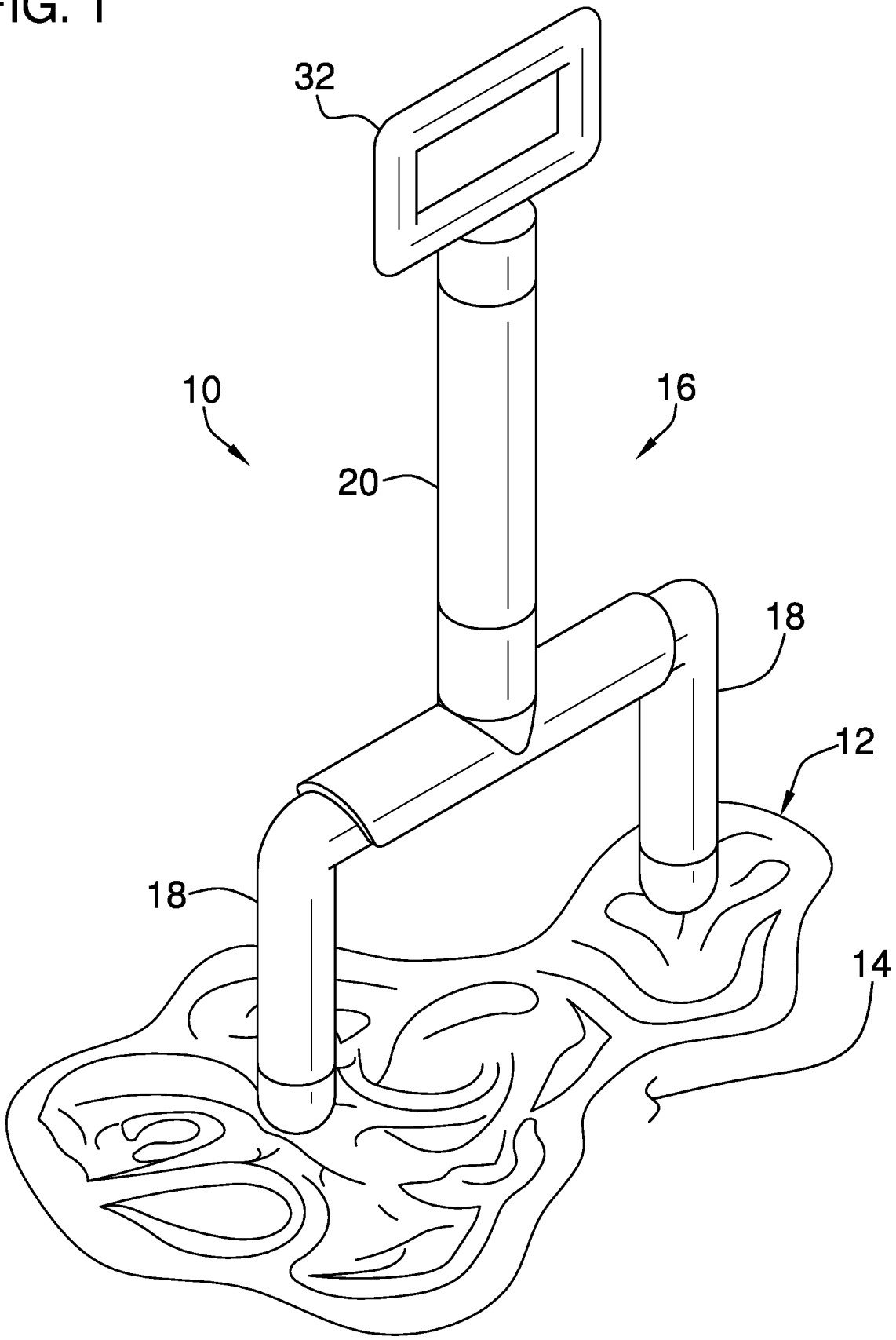
FIG. 1 is a perspective in-use view of a surface texturing assembly according to an embodiment of the disclosure.
Figure 2:
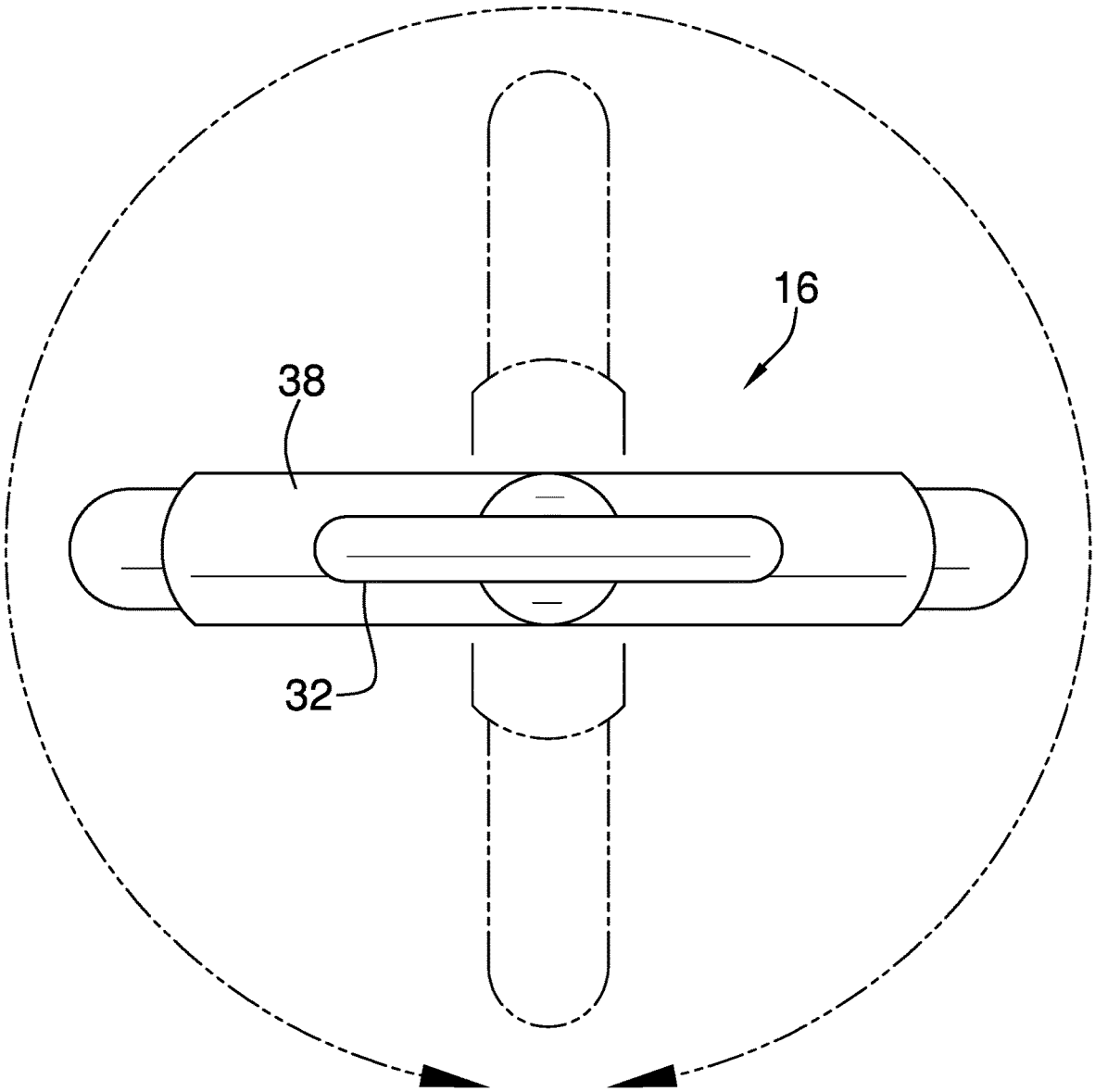
FIG. 2 is a top view of an embodiment of the disclosure.
Figure 3:
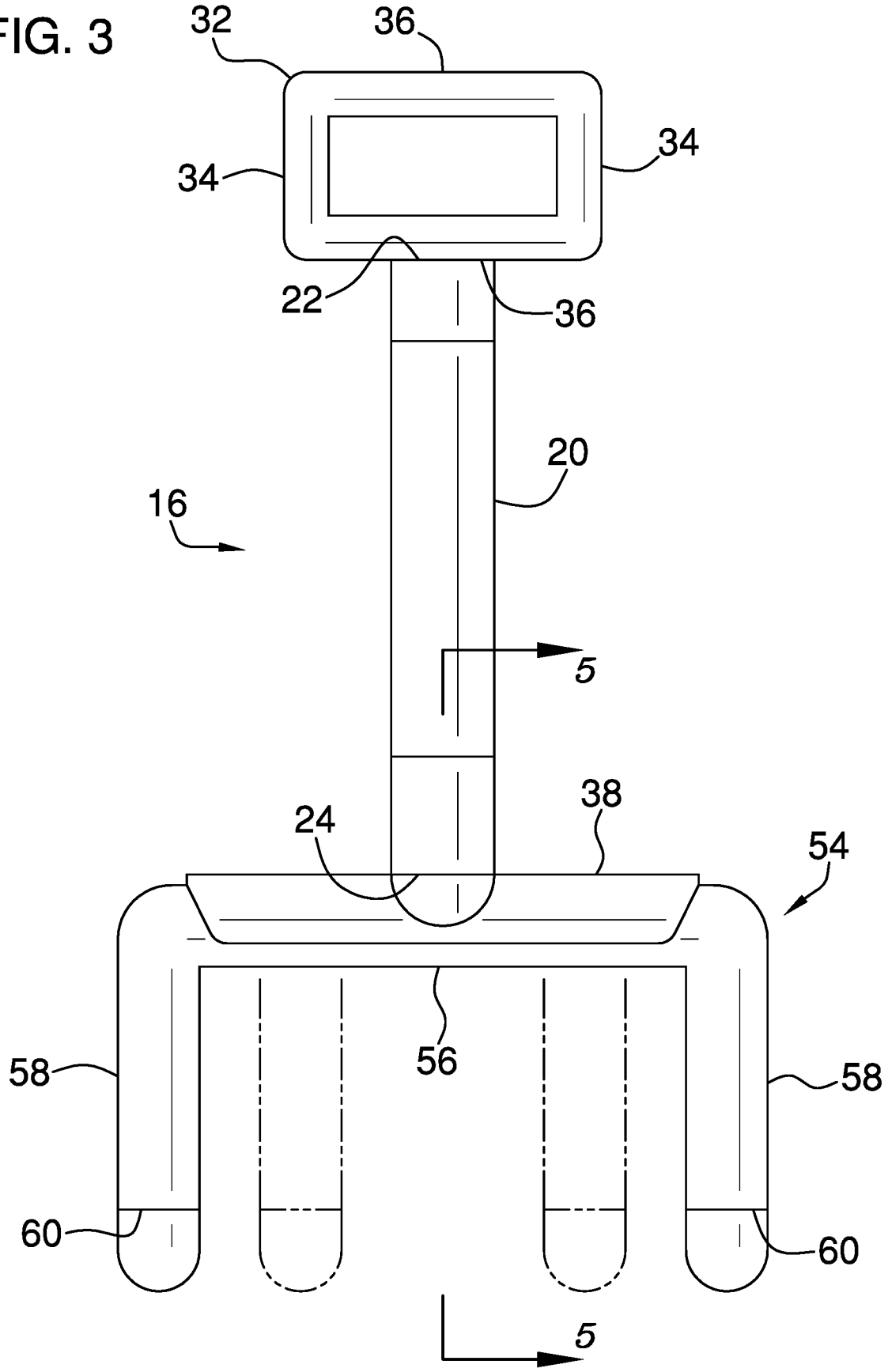
FIG. 3 is a front view of an embodiment of the disclosure.
Figure 4:
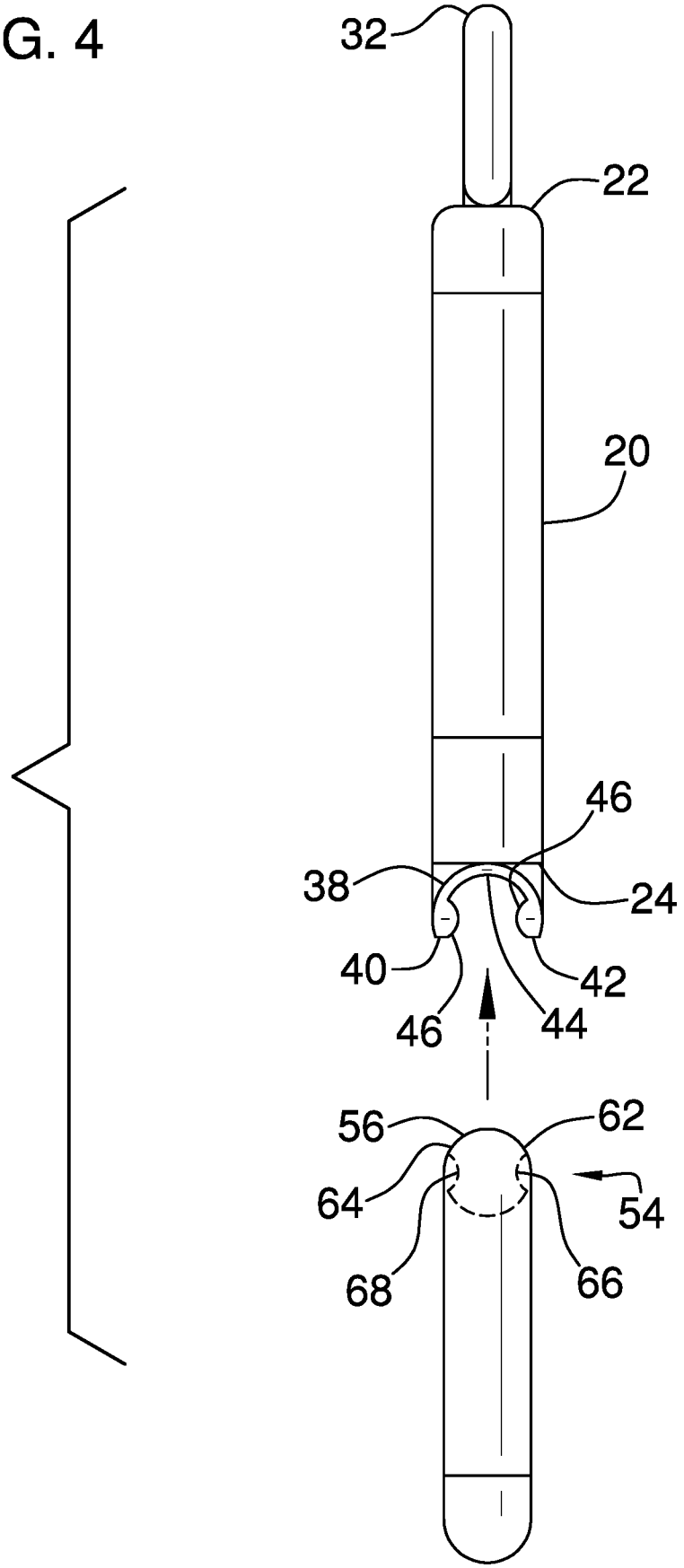
FIG. 4 is a right side exploded view of an embodiment of the disclosure.
Figure 5:
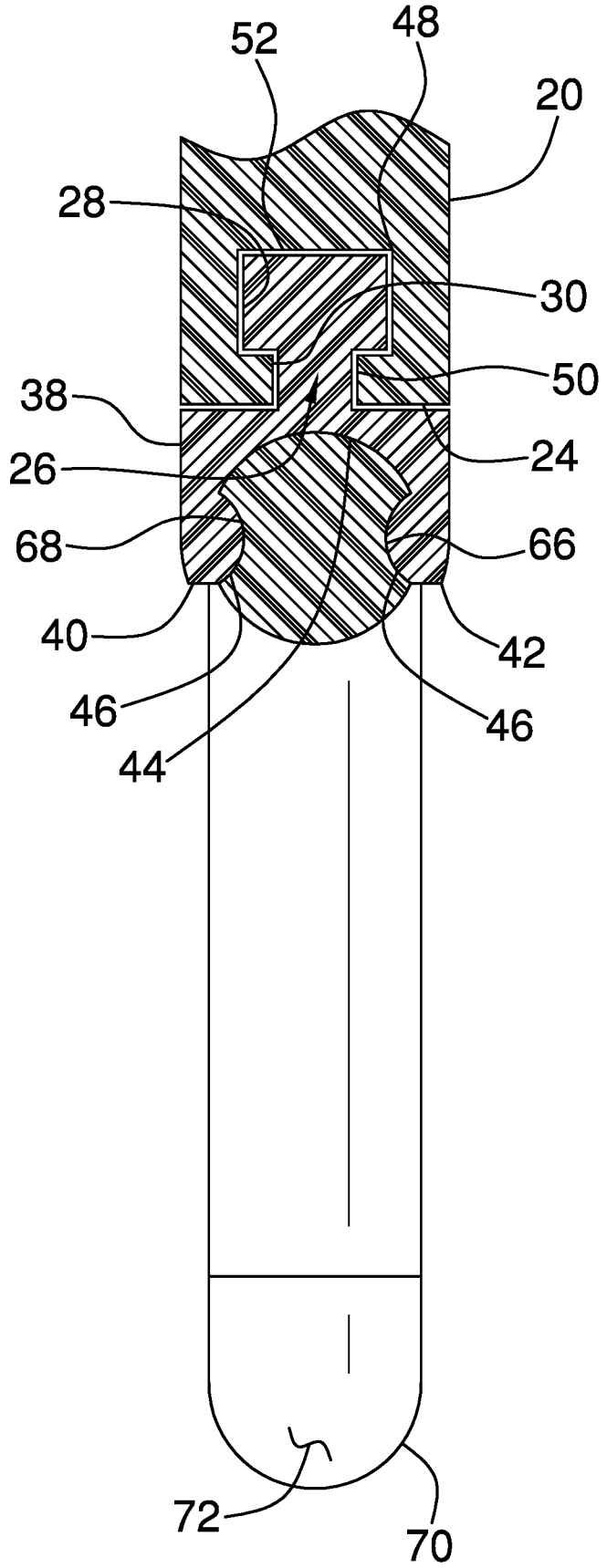
FIG. 5 is a cross sectional view taken along line 5-5 of FIG. 3 of an embodiment of the disclosure.
Figure 6:
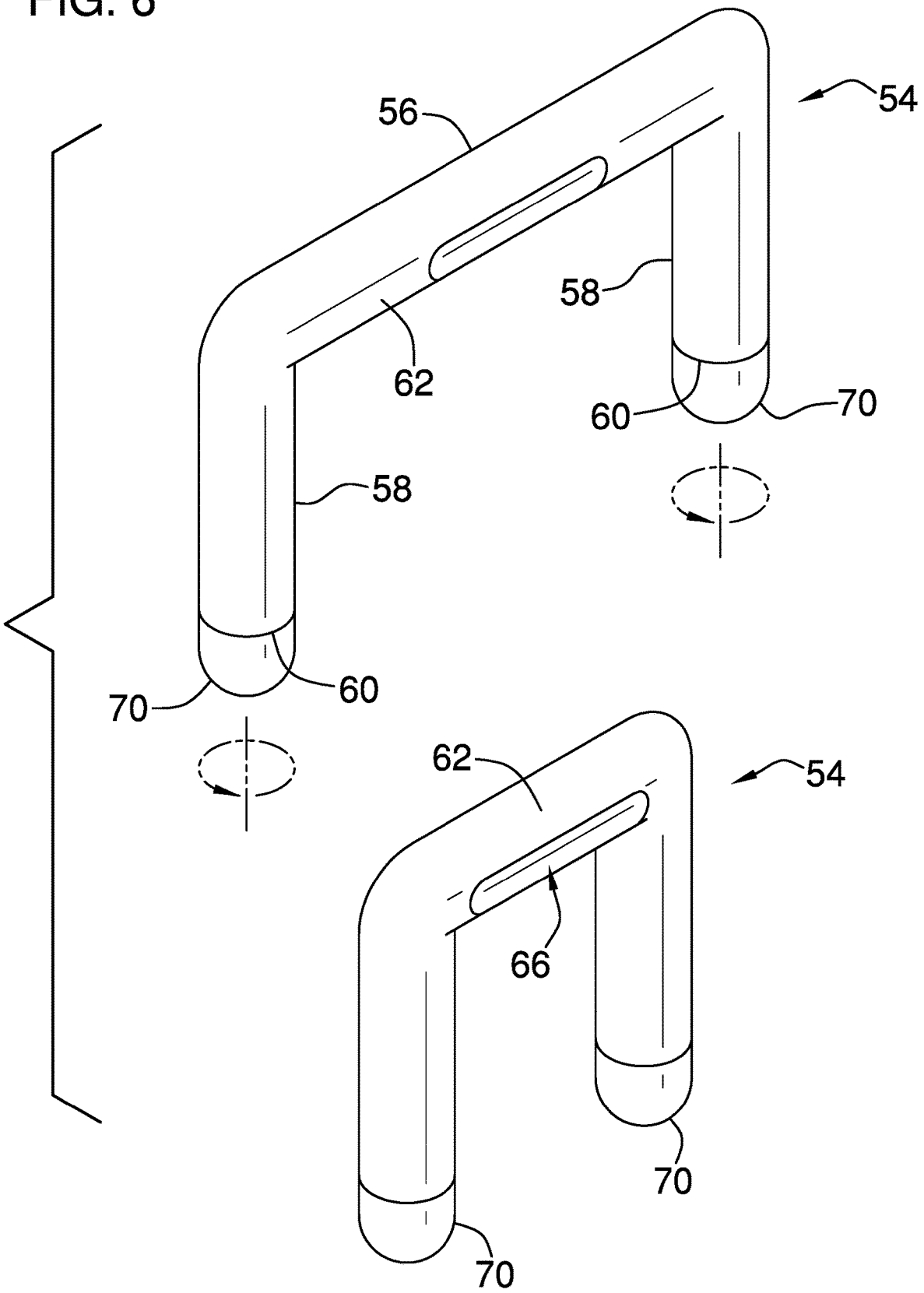
FIG. 6 is a perspective view of a pair of swirling units of an embodiment of the disclosure.
Figure 7:
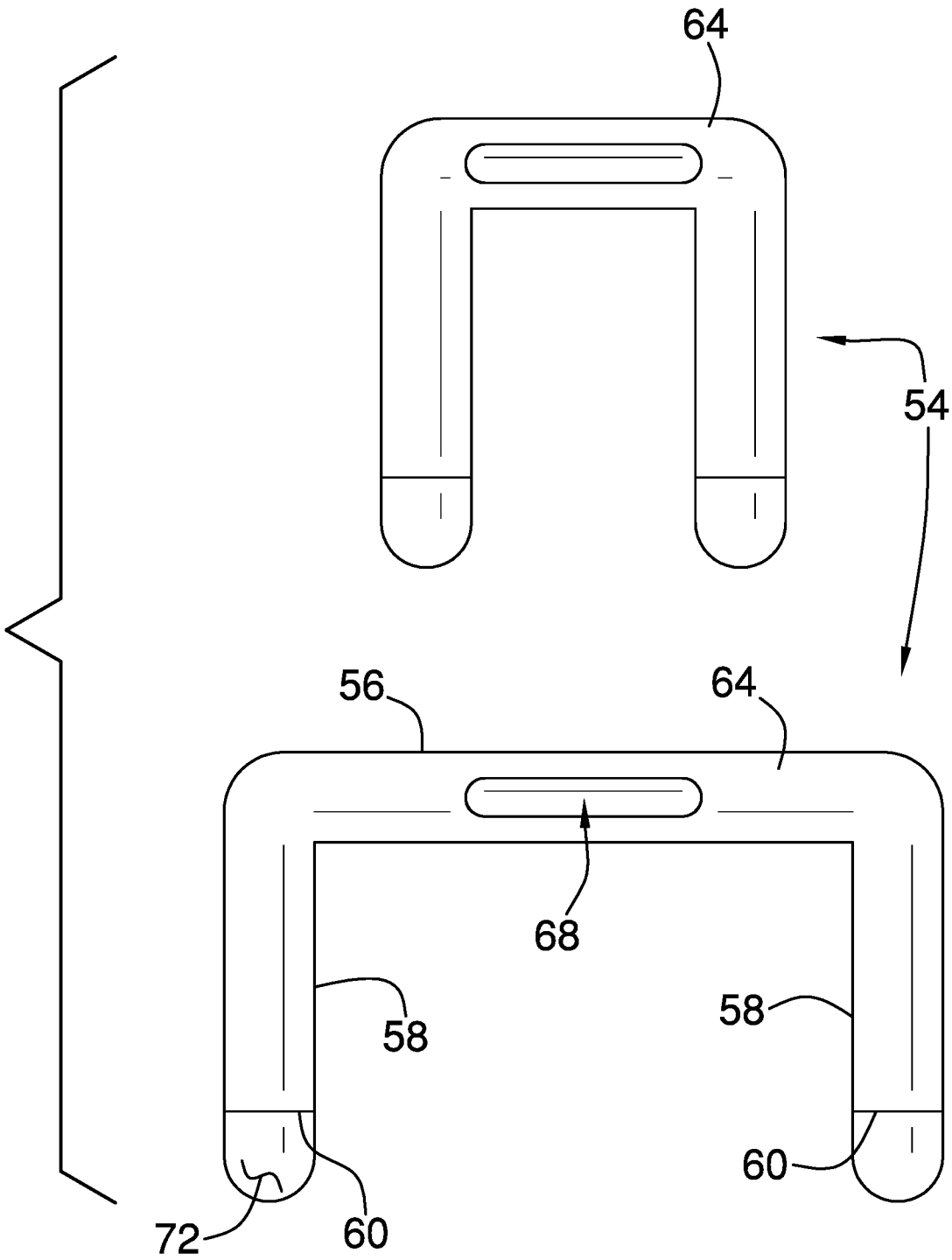
FIG. 7 is a front view of a pair of swirling units of an embodiment of the disclosure.

With reference now to the drawings, and in particular to FIGS. 1 through 7 thereof, a new texturing device embodying the principles and concepts of an embodiment of the disclosure and generally designated by the reference numeral 10 will be described.

As best illustrated in FIGS. 1 through 7, the surface texturing assembly 10 generally comprises a cementitious material 12 that is applied to an exposed surface 14 for enhancing the ornamental appearance of the exposed surface 14. The exposed surface 14 may be a wall in a room, an outer surface of a vase or an exposed surface of any object that is being remodeled or repurposed. The cementitious material 12 may be joint compound, plaster, concrete or any other cementitious material that will harden into the shape in which the cementitious material has been formed.

A swirling tool 16 is provided and the swirling tool 16 is manipulated to engage the cementitious material 12 when the cementitious material 12 is still wet on the exposed surface 14. The swirling tool 16 has a pair of spaced members 18 that each sinks into the cementitious material 12 when the swirling tool 16 is manipulated to engage the cementitious material 12. Moreover, the swirling tool 16 is rotatable such that each of the spaced members 18 travels in an arc to form a respective one of a pair of swirling arcs in the cementitious material 12. Additionally, the swirling tool 16 is movable along an entirety of the exposed surface 14 for shaping the cementitious material 12 into a plurality of swirling, intersecting arcs.

The swirling tool 16 comprises a shaft 20 that has a first end 22 and a second end 24, and the second end 24 has a well 26 extending toward the first end 22. The well 26 has an upper portion 28 which has a diameter that is greater than a diameter of a lower portion 30. The swirling tool 16 includes a handle 32 that has a pair of first members 34 each extending between a pair of second member 36. The first members 34 are spaced apart from each other such that the handle 32 defines a rectangular shape. A respective one of the second members 36 is coupled to the first end 22 of the shaft 20 for gripping the handle 32.

The swirling tool 16 includes a saddle 38 that has a first edge 40, a second edge 42 and a first surface 44 extending therebetween. The first surface 44 is concavely arcuate between the first 40 and second 42 edges such that the first edge 40 is spaced from the second edge 42. The first surface 44 has a pair of prominences 46 thereon. Each of the prominences 46 is aligned with a respective first 40 and second 42 edges and each of the prominences 46 is coextensive with the respective first 40 and second 42 edge.

A coupler 48 is coupled to and extends upwardly from the saddle 38 and the coupler 48 comprises a stem 50 and a head 52. The stem 50 extends through the lower portion 30 of the well 26 in the second end 24 of the shaft 20 such that the shaft 20 is rotatably coupled to the saddle 38 having the first 40 and second 42 edges of the saddle 38 being directed away from the shaft 20. Additionally, the head 52 is positioned within the upper portion 28 of the well 26 thereby inhibiting the coupler 48 from being removed from the well 26.

The swirling tool 16 includes a pair of shaping units 54. Each of the shaping units 54 comprises a first member 56 extending between a pair of end members 58. Each of the end members 58 of the shaping units 54 has a distal end 60 with respect to the first member 56 of a respective shaping unit 54. The first member 56 of each of the shaping units 54 has a front side 62 and a back side 64.

The front side 62 of the first member 56 of each of the shaping units 54 has a first recess 66 extending inwardly therein and the first recess 66 extends substantially between the end members 58 of a respective one of the shaping units 54. The back side 64 of the first member 56 of each of the shaping units 54 has a second recess 68 extending inwardly therein and the second recess 68 extends substantially between the end members 58 of a respective one of the shaping units 54. The first member 56 of a selected one of the shaping units 54 is positioned in the saddle 38 to releasably retain the selected shaping unit 54 on the shaft 20. Each of the prominences 46 on the first surface 44 of the saddle 38 engages a respective one of the first 66 and second 68 recesses on the selected shaping unit 54 for removably coupling the selected shaping unit 54 to the saddle 38. Additionally, each of the end members 58 of the selected shaping unit 54 is oriented collinear with the shaft 20 when the selected shaping unit 54 is coupled to the saddle 38.

The swirling tool 16 includes a plurality of feet 70 and each of the feet 70 is rotatably coupled to the distal end 60 of a respective one of the end members 58 of a respective one of the shaping units 54. Each of the feet 70 has a distal surface 72 with respect to the distal end 60 of the respective end member 58. The distal surface 72 of each of the feet 70 is concavely arcuate with respect to the distal end 60 of the respective end member 58. Each of the shaping units 54 has a pair of the feet 70 being associated therewith.

Each of the feet 70 on the associated shaping unit 54 sinks into the cementitious material 12 when the associated shaping unit 54 is urged into the cementitious material 12. Each of the end members 58 of the associated shaping unit 54 rotates about an axis extending through the first 22 and second 24 ends of the shaft 20 when the handle 32 is rotated. In this way each of the feet 70 on the associated shaping unit 54 produces the swirling arcs. As is most clearly shown in FIG. 7, the first member 56 of each of the shaping units 54 has a unique length with respect to each other.

In use, the cementitious material 12 is applied to the exposed surface 14 to a desired thickness, generally ranging between approximately 0.5 inches and 2.0 inches. The first member 56 of the selected shaping unit 54 is positioned in the saddle 38 to removably couple the selected shaping unit 54 to the shaft 20. The handle 32 is gripped and each of the end members 58 of the selected shaping unit 54 is pushed into the cementitious material 12 until the feet 70 on each of the end members 58 abuts the exposed surface 14 to which the cementitious material 12 has been applied. The handle 32 is rotated, thereby facilitating each of the feet 70 to travel along the exposed surface 14 in an arc. The shaping unit 54 is continually relocated on the exposed surface 14, and the handle 32 is rotated each time the shaping unit 54 is relocated. In this way the entirely of the cementitious material 12 can be textured and shaped with a continuous pattern of swirling, intersecting arcs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A surface texturing assembly being configured to produce a swirling, textured effect in a cementitious material configured to be applied to an exposed surface for enhancing the ornamental appearance of the exposed surface, said assembly comprising:

a swirling tool being manipulated to engage the cementitious material when said cementitious material is wet, said swirling tool having a pair of spaced members that each sinks into the cementitious material when said swirling tool is manipulated to engage the cementitious material, said swirling tool being rotatable such that each of said spaced members travels in an arc to form a respective one of a pair of swirling arcs in said cementitious material, said swirling tool being movable along an entirety of the exposed surface for shaping said cementitious material into a plurality of swirling, intersecting arcs, said swirling tool comprising a shaft having a first end and a second end, said second end having a well extending toward said first end, said well having an upper portion having a diameter being greater than a diameter of a lower portion of said well, a handle having a pair of first members each extending between a pair of second members, said first members being spaced apart from each other such that said handle defines a rectangular shape, a respective one of said second members being coupled to said first end of said shaft wherein said handle is configured to be gripped, and a saddle having a first edge, a second edge and a first surface extending therebetween, said first surface being concavely arcuate between said first and second edges such that said first edge is spaced from said second edge, said first surface having a pair of prominences thereon, each of said prominences being aligned with a respective first and second edges, each of said prominences being coextensive with said respective first and second edge.

2. The assembly according to claim 1, wherein said swirling tool further comprises a coupler being coupled to and extending upwardly from said saddle, said coupler comprising a stem and a head, said stem extending through said lower portion of said well in said second end of said shaft such that said shaft is rotatably coupled to said saddle having said first and second edges of said saddle being directed away from said shaft, said head being positioned within said upper portion of said well thereby inhibiting said coupler from being removed from said well.

3. The assembly according to claim 1, wherein said swirling tool includes a pair of shaping units, each of said shaping units comprising a first member extending between a pair of end members, each of said end members of said shaping units having a distal end with respect to said first member of a respective shaping unit.

4. The assembly according to claim 3, wherein said first member of each of said shaping units has a front side and a back side, said front side of said first member of each of said shaping units having a first recess extending inwardly therein, said first recess extending substantially between said end members of a respective one of said shaping units, said back side of said first member of each of said shaping units having a second recess extending inwardly therein, said second recess extending substantially between said end members of a respective one of said shaping units.

5. The assembly according to claim 4, wherein each of said prominences on said first surface of said saddle engages a respective one of said first and second recesses on a selected one of said shaping units for removably coupling said selected shaping unit to said saddle, each of said end members of said selected shaping unit being oriented parallel to said shaft when said selected shaping unit is coupled to said saddle.

6. The assembly according to claim 3, wherein said swirling tool includes a plurality of feet, each of said feet being rotatably coupled to said distal end of a respective one of said end members of a respective one of said shaping units, each of said feet has a distal surface with respect to said distal end of said respective end member, said distal surface of each of said feet being concavely arcuate with respect to said distal end of said respective end member.

7. The assembly according to claim 6, wherein each of said shaping units has a pair of said feet being associated therewith, each of said feet on associated shaping unit sinking into the cementitious material, each of said end members of said associated shaping unit rotating about an axis extending through said first and second ends of said shaft when said handle is rotated thereby facilitating each of said feet on said associated shaping unit to produce the swirling arcs, said central member of each of said shaping units having a unique length with respect to each other.

8. A surface texturing assembly being configured to produce a swirling, textured effect in a cementitious material configured to be applied to an exposed surface for enhancing the ornamental appearance of the exposed surface, said assembly comprising:

a swirling tool being manipulated to engage the cementitious material when said cementitious material is wet, said swirling tool having a pair of spaced members that each sinks into the cementitious material when said swirling tool is manipulated to engage the cementitious material, said swirling tool being rotatable such that each of said spaced members travels in an arc to form a respective one of a pair of swirling arcs in said cementitious material, said swirling tool being movable along an entirety of the exposed surface for shaping said cementitious material into a plurality of swirling, intersecting arcs, said swirling tool comprising:

a shaft having a first end and a second end, said second end having a well extending toward said first end, said well having an upper portion having a diameter being greater than a diameter of a lower portion of said well;

a handle having a pair of first members each extending between a pair of second members, said first members being spaced apart from each other such that said handle defines a rectangular shape, a respective one of said second members being coupled to said first end of said shaft wherein said handle is configured to be gripped;

a saddle having a first edge, a second edge and a first surface extending therebetween, said first surface being concavely arcuate between said first and second edges such that said first edge is spaced from said second edge, said first surface having a pair of prominences thereon, each of said prominences being aligned with a respective first and second edges, each of said prominences being coextensive with said respective first and second edge;

a coupler being coupled to and extending upwardly from said saddle, said coupler comprising a stem and a head, said stem extending through said lower portion of said well in said second end of said shaft such that said shaft is rotatably coupled to said saddle having said first and second edges of said saddle being directed away from said shaft, said head being positioned within said upper portion of said well thereby inhibiting said coupler from being removed from said well; and a pair of shaping units, each of said shaping units comprising a first member extending between a pair of end members, each of said end members of said shaping units having a distal end with respect to said first member of a respective shaping unit, said first member of each of said shaping units having a front side and a back side, said front side of said first member of each of said shaping units having a first recess extending inwardly therein, said first recess extending substantially between said end members of a respective one of said shaping units, said back side of said first member of each of said shaping units having a second recess extending inwardly therein, said second recess extending substantially between said end members of a respective one of said shaping units, each of said prominences on said first surface of said saddle engaging a respective one of said first and second recesses on a selected one of said shaping units for removably coupling said selected shaping unit to said saddle, each of said end members of said selected shaping unit being oriented parallel to said shaft when said selected shaping unit is coupled to said saddle; and a plurality of feet, each of said feet being rotatably coupled to said distal end of a respective one of said end members of a respective one of said shaping units, each of said feet having a distal surface with respect to said distal end of said respective end member, said distal surface of each of said feet being concavely arcuate with respect to said distal end of said respective end member, each of said shaping units having a pair of said feet being associated therewith, each of said feet on associated shaping unit sinking into the cementitious material, each of said end members of said associated shaping unit rotating about an axis extending through said first and second ends of said shaft when said handle is rotated thereby facilitating each of said feet on said associated shaping unit to produce the swirling arcs, said central member of each of said shaping units having a unique length with respect to each other.

* * * * *